US005356076A

United States Patent [19]

Bishop

[11] Patent Number: 5,356,076

[45] Date of Patent: Oct. 18, 1994

[54] SHOWER SOAP DISPENSER FOR LIQUID SOAPS

[76] Inventor: Robert A. Bishop, 110 Dry Creek Rd., Hollister, Calif. 95023

[21] Appl. No.: 38,216

[22] Filed: Mar. 29, 1993

[51] Int. Cl.[5] ..... B05B 7/30

[52] U.S. Cl. ..... 239/311; 239/318; 239/335; 239/581.1

[58] Field of Search ..... 239/310, 311, 315, 318, 239/335, 581.1; 137/889, 893, 894, 625.41

[56] References Cited

U.S. PATENT DOCUMENTS

| | | | |
|---|---|---|---|
| 2,316,781 | 4/1943 | Fox | 239/310 |
| 2,462,752 | 2/1949 | Kotches et al. | 239/318 X |
| 2,690,717 | 10/1954 | Goodrie | 239/318 X |
| 2,719,704 | 10/1955 | Anderson et al. | 239/318 X |
| 3,106,345 | 10/1963 | Wukowitz | 239/310 X |
| 3,231,200 | 1/1966 | Heald | 239/318 |
| 3,764,074 | 10/1973 | James | 239/318 |
| 3,797,747 | 3/1974 | Buzzi et al. | 239/318 X |
| 4,623,095 | 11/1986 | Pronk | 239/318 X |
| 4,651,930 | 3/1987 | Magaha, Jr. | 239/318 |
| 4,901,765 | 2/1990 | Poe | 239/318 X |

*Primary Examiner*—Andres Kashnikow
*Assistant Examiner*—William Grant
*Attorney, Agent, or Firm*—Michael L. Harrison

[57] ABSTRACT

An improved design for a soap dispenser for use with liquid soaps, primarily in showers, has a unique multi-position valve, and separate mixing and air entraining controls. Liquid soap stored in a reservoir is drawn into a flowing water stream by siphonic action. The amount of soap/air mixture is regulated by a mixture valve. Air in controllable proportions is added by an air entrainment valve. The proportion of air with respect to the soap is adjustable. Simultaneous control of the amount of soap/air mixed with the flowing water stream is controlled by a unique mixture valve geometry.

1 Claim, 5 Drawing Sheets

SHOWER SOAP DISPENSER FOR LIQUID SOAPS

BACKGROUND OF THE INVENTION

1. Field of the Invention

The present invention relates to sap dispenser apparatuses and in particular to liquid soap dispenser apparatuses for attachment to conventional shower pipe and shower heads used in showers.

2. Prior Art

The need for a convenient means for dispensing soap in showers has led to sometimes creating complex manufacturing problems and to difficulties in installation.

The devices found in the prior art do not provide the convenience, flexibility and economy which is sought by consumers, and accordingly have been commercially unsuccessful.

Virtually all of the prior art devices suffer the characteristic that they add significant length and downward drop to the shower pipe, thereby placing the shower head at a lower than optimum position.

Magaha, Jr., U.S. Pat. No. 4,651,930 shows a unit which has a soap mixture adjustment valve to regulate the amount of soap being dispensed, but requires that the soap must be of a "proper viscosity" and, needs biodegradable soap to prevent clogging. The drawings show both delivery passages 28 and 29 as being of the same size, which, if true would mean that the water volume delivered during the rinse mode is the same amount as volume delivered during the soap mode. In this situation either the soap will be wasted or the flow rate will be inadequate for the rinse mode. Moreover, the design of the unit would require that the user change the typical water supply pipe of a shower, which is bent at a 45 degree angle, into a straight supply pipe.

Eddy, et.al., U.S. Pat. No. 3,894,662, shows a dispenser apparatus in which the soap mixture must be adjusted each time the main handle is operated into the soap position. This takes time for delivery flow to adjust, thus wasting soap, water, and time. Nor does the device have a full OFF position, where both soap & water are stopped so that a bather can lather up after soap has been delivered. Both the water only delivery passage and the soap and water delivery passages are one and the same, thus creating the same problems as noted above for Magaha. Neither does the unit contain a check valve, necessary for use with low-flow shower heads. Back pressure from, e.g., a low-flow head, would force water into the soap container during the rinse mode. No seal is shown to prevent this, although an 0-ring seal is shown to prevent the handle from leaking. This unit lacks a separate soap mixture adjustment valve, thereby precluding pre-setting of the mixture. To obtain a desired mixture of soap and water one must adjust the unit experimentally upon each use.

LeMond, U.S. Pat. No. 3,847,354, shows a dispenser unit which, in the dispensing mode, diverts water into the soap container producing a soap/water mixture which then flows up and out of the dispenser. This action will continually dilute the soap until it is gone. A consistent mix of soap and water therefore cannot be obtained by this device. This unit also lacks a full OFF position whereby both soap and water flow can be stopped for lathering-up.

Johnson, U.S. Pat. No. 3,539,111, employs the same type of dispenser and has the same difficulties as LeMond, above.

James, U.S. Pat. No. 3,764,074, does not have a separate soap adjustment valve. The soap flow is dependent upon built-in orifice sizes and very minute handle movements. If any adjustment of soap volume is even possible at all it would have to be done each time the handle is moved from "soap" to "rinse" position, again wasting soap and water. The unit also lacks an OFF position or lather-up position where both the flow of soap and water arc stopped, lacks a check valve for the soap container, and lacks positive seals to prevent back pressure from filling the soap container with water if back-pressure is encountered as is typical when "low-flow" shower heads are used. The unit also lacks an aeration adjustment.

Sheldall, U.S. Pat. No. 3,445,067, shows a soap dispenser unit which does not have a soap adjustment. The user has no control over the amount of soap being dispensed during the soap mode. The unit also lacks an OFF position so that there is no flow of water or soap and water to allow the user to "lather-up". The water delivery passage and the soap and water delivery passage are of the same dimensions, leading again to the same problems described above for Magaha.

Camp, U.S. Pat. No. 3,352,320, shows a device having no soap mixture adjustment valve to regulate the amount of soap being dispensed. Nor does the unit have an OFF position for "lather-up" whereby there is no flow of soap or water. The unit likewise does not contain a check valve to prevent water from entering the soap container if back-pressure is encountered as is typical when "low-flow" shower heads are used.

Heald, U.S. Pat. No. 3,231,200, does not have an OFF position or "lather-up" position, whereby there is no flow of water only or soap and water. The soap mixture has to be adjusted each time the operating handle is turned to the soap position, which takes time for delivery flow to adjust out, thus wasting water, soap, and time. Both the water only delivery passage, and the soap and water delivery passage are one and the same. In order for the siphon to work, the orifice upstream of the siphon must be smaller than the orifice downstream of the siphon, for if restrictive shower heads such as prescribed by the American National Standards Institute (A.N.S.I.) and the California Energy Commission (C.E.C.) are used, one cannot attain the fullest flow rate in rinse mode.

Mills, U.S. Pat. No. 3,212,716 shows the same structure as James, above, and would present the same problems.

Deport, U.S. Pat. No. 2,672,366, an early attempt at solving the dispenser problem, teaches the use of gravity food or an auxiliary pump. The unit is neither self-contained nor self-pressurizing. The soap adjustment is done by changing interior-mounted threaded plugs. This cannot be done while the unit is in use, and consequently does not allow fine adjustments during use.

SUMMARY OF THE INVENTION

Accordingly it is an object of the present invention to provide a soap dispensing apparatus, primarily for use in a shower, which interconnects to a source of pressurized water and a reservoir of liquid soap, and which provides for single handle control adjustment of the proportioned liquid soap into the water stream.

It is a further object of the present invention to provide a control means capable of mixing a liquid soap into a low flow rate of water.

It is yet another object of the present invention to provide a soap dispenser which can separately regulate the soap mixture and the amount of soap delivered independently of the water flow variation, for causing the soap/water mixture to be produced in a pre-sudsed condition It is yet another object of the present invention to provide a soap dispenser which operates over a wide range of water pressures and volume rates.

These and other objects of the present invention are accomplished by providing an improved design for a soap dispenser for use in showers, and for use with liquid soaps, having a unique multi-action valve, and having separate mixing and air-entraining controls. Liquid soap stored in a reservoir is drawn into a flowing water stream by siphonic action. The amount of soap-/air mixture is regulated by a mixture valve. Air in controllable proportions is added by an air entrainment valve. The proportion of air with respect to the soap is adjustable. The amount of soap/air mixed with the flowing water stream is controlled simultaneously by the unique mixture valve geometry, in which the main passages are positioned and intersected within a main valve element, such that in one position one main passage delivers water directly without soap being mixed therein, and in another position, that same main passage is related to connect to the soap/air feed line, whereby it then serves as the conduit into the second main passage of the valve element, for delivering soap/air mixture into the flowing water stream. In still a third position, the unique valve geometry prevents flow in any of the main valve element passages.

The air mixture valves and the reservoir siphon line contain ball-check valves to prevent reverse flow of the liquids.

The above, and other features and advantages of the present invention will be set forth more completely in the description of the preferred embodiment, including the following drawings.

BRIEF DESCRIPTION OF THE DRAWINGS

FIG. 4(*b*) is a section view of the main valve element of the soap dispenser in accordance with the present invention taken along section line C—C′ in FIG. 4(*a*).

FIG. 5(*b*) is a side view of a soap dispenser in accordance with the present invention showing the main valve operated to the "off" position.

FIG. 5(*c*) is a side view of a soap dispenser in accordance with the present invention showing the main valve operated to the "rinse" position.

DESCRIPTION OF THE PREFERRED EMBODIMENT

In FIGS. 1, 2, 3, and 4, the geometry of a soap dispenser in accordance with the present invention is shown. Due to the new geometry of the present device, a liquid soap dispenser having greater convenience, economy, and flexibility than the prior art devices is possible.

Figure 1:
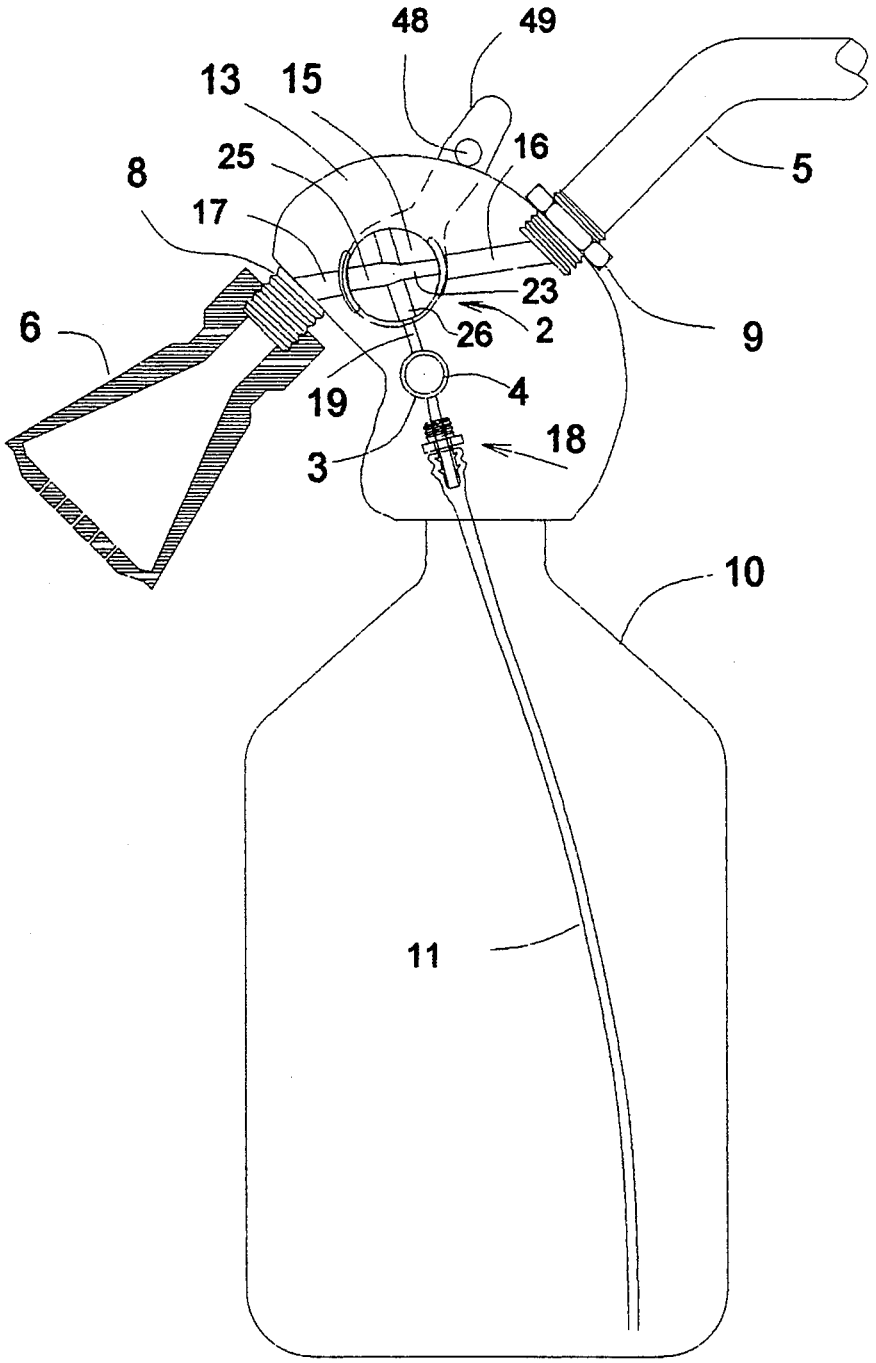
FIG. 1 is an overall perspective view of the soap dispenser in accordance with the present invention, showing its installation on the pipe conventionally found in a shower stall, and the soap reservoir attached.

Referring now to FIG. 1 the liquid shower soap dispenser 1 in accordance with the present invention is shown, in an overall perspective view, connected to a conventional water supply pipe 5 and a conventional shower head 6 which are normally found in a conventional shower installation.

The dispenser device of the present invention is housed in the body 13 in which is located the main valve 2 including the main valve cavity 14 and the main valve element 15. The passages 23, 25 and 26 through the main valve element 15 communicate with the inlet and outlet passages 16 and 17, and with the soap/air mixture conduit 19 in the body 13. Inlet passage 16 communicates with the water supply pipe 5. Outlet passage 17 communicates with the shower head 6. Soap/air conduit 19 in turn communicates with a reservoir 10 which contains liquid soap. The various elements of the present invention are formed in a manner which is well-known in the art.

The main valve clement 15 is rotated by a selector handle 49 which attaches to the main valve element 15 and rotates it in accordance with the user's needs. The reservoir 10 contains a liquid soap from which the soap supply is drawn through supply tube 11 for mixing with air and water. A soap valve 3 and an air valve 4, behind the soap valve in the figure, are provided.

The soap valve 3 controls the amount of soap which is mixed into the water stream to suit individual user preferences and to accommodate different viscosities of liquid soaps.

The air valve 4 controls the amount of air which is introduced into the soap before it is mixed with the flowing water. The range can be varied from maximum air down to no air. In general, mixing air into the soap, and eventually into the flowing water stream, results in a more sudsy shower spray.

In use, the dispenser I provides three modes, a "soap" mode, a "rinse" mode, and an "Off" mode.

In the soap mode, the dispenser 1 adds soap into the water stream allowing it to be showered, already lathered or "sudsed", onto the user. Since the user is applying soap and does not want to have it immediately washed off, the water flow in this position is reduced. This has the additional benefit of saving water and soap in comparison with the usual practice of running the water at a high rate even when soap is being manually applied.

In the rinse mode, water is delivered unimpeded to the shower head 6 by means of a straight through passage 26 in the main valve element. Water flow is restored to normal.

In the off mode, no water flow at all is allowed. This allows the user to wash with the water flow stopped, again saving both water and soap, but immediately restoring water flow at the precisely set volume and temperature setting when the user wishes to do so.

Figure 2:
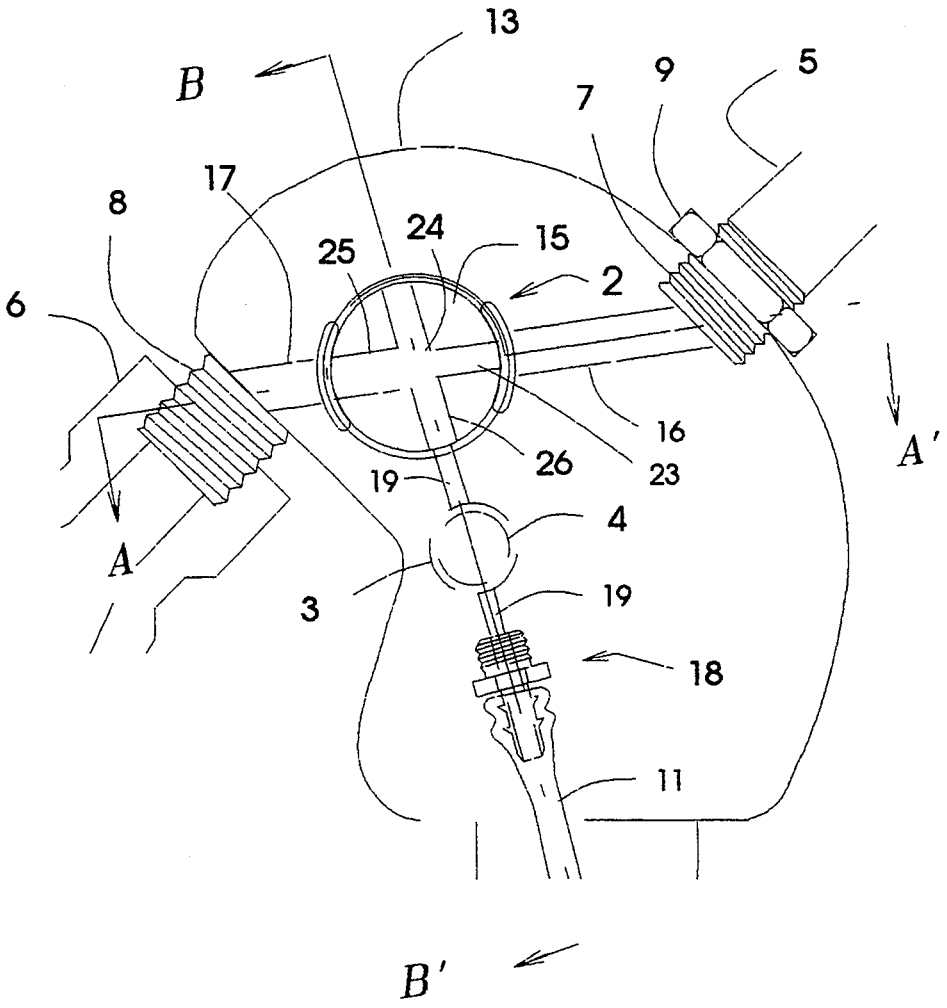
FIG. 2 is a side view of a soap dispenser in accordance with the present invention.
Figure 3:
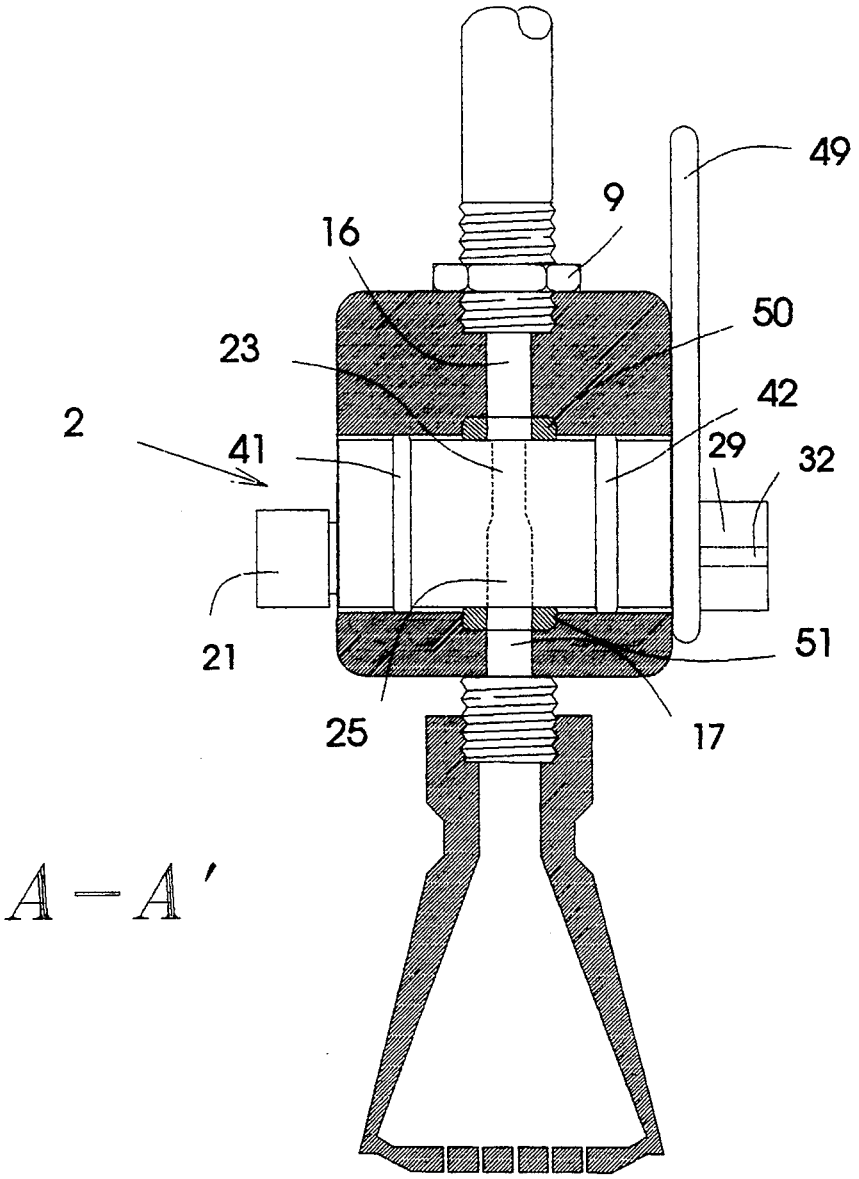
FIG. 3 is a section view of a soap dispenser in accordance with the present invention taken along section line A—A′ of FIG. 2.
Figure 4A:
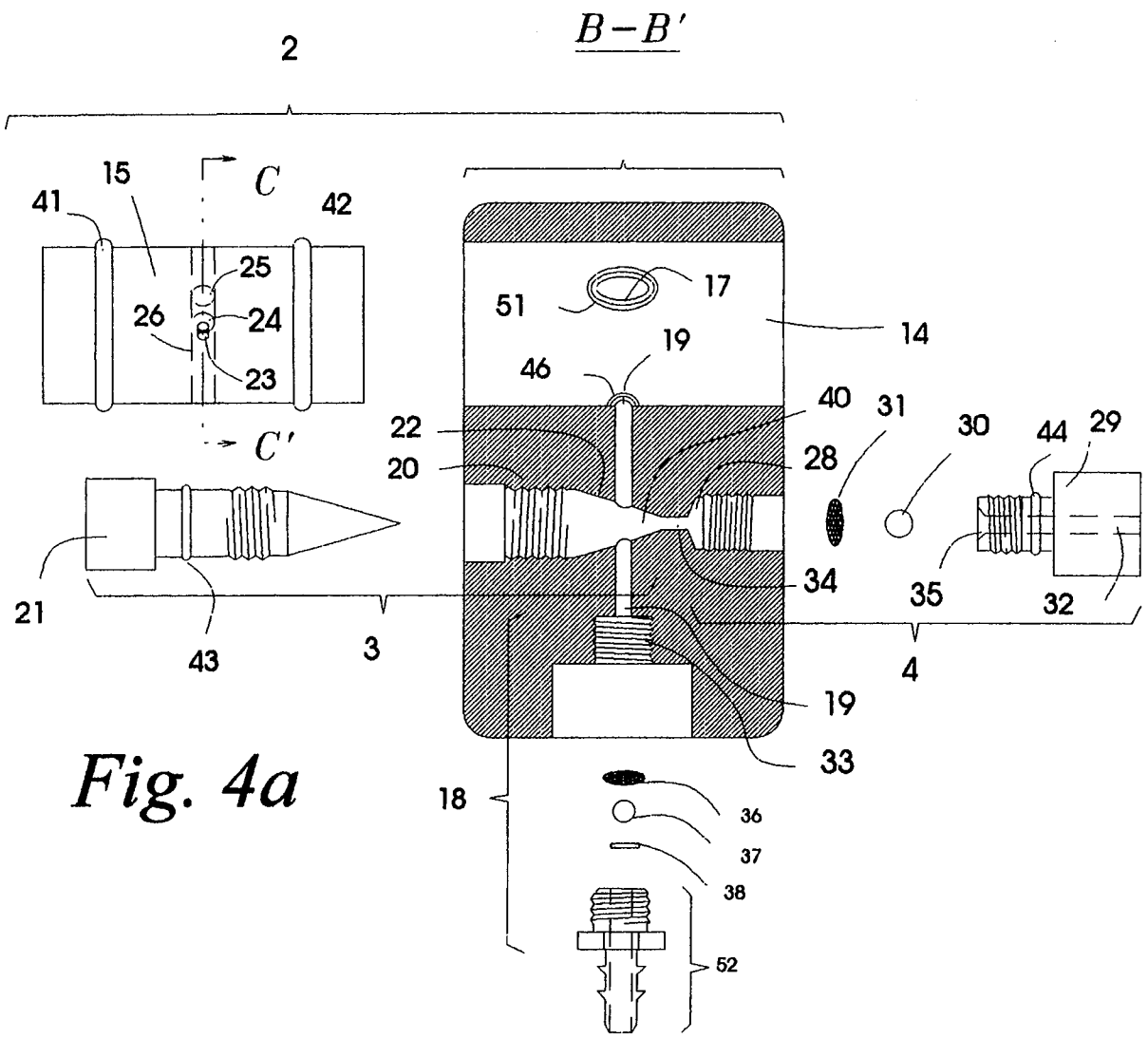
FIG. 4(*a*) is a section view of a soap dispenser in accordance with the present invention taken along line B—B′ of FIG. 2. The body is shown in section. The valve elements are shown in standard side views.
Figure 4B:
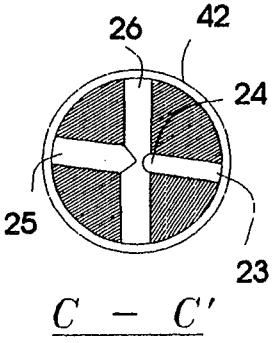

Turning now to FIGS. 2, 3, and 4(*a*) and 4(*b*), there is shown in greater detail the liquid soap dispenser of the present invention.

The salient features of the main valve are depicted in FIGS. 2, 3, 4(*a*) and 4(*b*). FIG. 2 is a side view of the soap dispenser 1 showing the workings of the main valve 2 in conjunction with the passageways 16, 17, and 19 of the body 13. FIG. 3 is a sectional view through section line A—A' of FIG. 2 and FIG. 4(*a*) is a sectional view through section lines B—B' of FIG. 2.

The main body 13 contains the main valve 2 comprising a main valve cavity 14 in which is located main valve element 15. Main valve cavity 14 and main valve element 15 cooperate to both control the flow of the main stream, i.e., whether it is "ON" or "OFF", and the mode of the dispenser 1, i.e., whether the dispenser 1 is mixing soap into the water stream or is providing water without soap, the "rinse" mode.

The various functions of the dispenser 1 are selected by rotation of the main valve element 15 to precise positions with respect to passageways in the body 13. The rinse and soap application position are critical. Finding their locator is therefore aided by a stop 48 on the handle 49. Main valve element 15 has the three positions mentioned above. Body 13 contains the necessary adaptations for connections to existing shower installation. Inlet 7 is threaded appropriately for fitting to the pipe 5. A lock-nut 9 tightens the dispenser after it has been threaded into the desired position. Outlet 8 is an externally threaded nipple for connection to the shower head 6.

Communicating with the inlet 7 is inlet water passage 16 which connects the inlet 7 to the main valve cavity 14. If the main valve element 15 is in the soap or rinse mode, water and/or water and soap combined is transmitted through the valve 2 and into the outlet conduit 17.

An important function of the main valve element 15 is the provision of a venturi tube for formation of a siphon. The inlet side of the valve 15 is a restricted passage 23 which opens into a flared passage 24, which in turn opens into an outlet passage 25. The combination of the restricted passage 23 and flared passage 24 produce a venturi tube which can siphon liquid soap, or a mixture of liquid soap and air through straight passage 26. The diameter of the restricted passage is critical. It must be small enough so that a downstream restriction, as presented for example by a "low-flow" shower head, will not interfere with the operation of the venturi. In practice, this means that the apparent total area of the orifices in the shower head 6 must be greater than the apparent total area of the restricted passage 23.

In FIG. 4(*a*), the relationship of the straight passage 26 to the valve body soap passage 19 may be seen for the main valve 2 in the soap application position. The soap passage 19 extends from the main valve cavity 14 to the check valve 18. Between the check valve 18 and the main valve cavity 14 the mixture control valves, consisting of the soap adjust valve 3 and the aerator valve 4, are located.

The soap adjust valve 3, shown in detail in FIG. 4(*a*), consists of a soap valve cavity 20 including soap valve seat 22 and a soap valve element 21, a combination which produces a needle valve control mechanism regulating the flow of soap and air both into the soap passage 19.

Soap and air are mixed by means of mixing area 40 which communicates with the soap reservoir 10 and the air passage 34, and which communicates with the valve seat 22 of the soap adjust valve cavity 20. From the mixing area, mixture conduit 19 carries the soap/air mixture to the main valve 2.

The air valve 4, shown in detail in FIG. 4(*a*), consists of a valve cavity 28, an air valve element 29, a ball 30 and a retainer screen 31. The air valve element 29 has an air inlet passage 32 which extends through its length. The air valve 4 operates by changing the restriction encountered by air which seeks to move under the urging of atmospheric pressure into the mixing area 40. Turning the threaded air valve element 29 advances it into the cavity 28. As the air valve element 29 advances, the ball 30 is urged into the opening 32 in the valve element 29. Ultimately, as the element continues to advance, the ball 30 is tightened against retaining screen 31. The pressure with which the ball is urged by the knob 29 against the screen 31 causes the ball to seat into the passage 32 which passes through the knob 29. The end of the passage which engages with the ball 30 is preferably a flare 35 or is otherwise adapted to the shape of the ball. The amount of advancement of the valve element 29 controls the amount of restriction provided by the ball 30, and in turn controls the case with which the air flows into the mixing area 40. Little advancement means that a relatively large volume of air will flow while greater advancement means that relatively little air will flow. Ultimately when the ball 30 is finally tightened against the screen 31, no air will flow through the valve 4. Valve 4 also provides a check valve function to prevent water and soap from flowing outward through passage 32. Such flow is most likely to occur when the dispenser is used with a low-flow shower head or any shower head that restricts the flow when the dispenser is operated in the "rinse" mode. This same back-flow pressure created by such conditions is contained by O-rings 41 and 42 on main valve 15, and by O-rings 50 & 51 which seal the interface with passages 16 and 17 in body 13. Similarly the back flow is contained by O-ring 43 located on soap valve element 21 and by O-ring 44 on air valve element 29.

Under some circumstances, already mentioned, water or water/soap mixture could flow into the reservoir 10 diluting the liquid soap contained in it. To prevent this, when backward flow is encountered, check valve 18 prevents flow.

Check valve 18 is comprised of valve seat 33 in which is located a threaded hose barb 52 which provides a seat for check ball 37. Screen 36 retains check ball 37 in position and prevents it from sealing the passage 19 against flow in the forward direction toward the mixing area 40.

Backward flow is prevented by the action of the check ball 37 settling into the opening in the hose barb 52. A soft seal 38, typically an "O"-ring, provides a conforming, leak-proof surface on which the surface of the check ball 37 can form an effective seal.

The position of the main valve element 15 determines which function the dispenser 1 performs. As described above, the straight passage 26 serves in one position as a conduit for water unmixed with soap or air. In another position, it serves as the conduit for the soap/air mixture and provides it to the flowing water stream at the inlet to the venturi 23, 24, and 25.

The stop is located so that when the handle is pushed away from the user, (to the right in the figures), the stop contacts the body 13 at precisely the angle of rotation which is required to align the inlet passage 23 with the inlet passage 16, and the venturi outlet 25 with the outlet passage 17. When the handle is pulled toward the user (to the left in the figures), the stop contacts the body 13 at precisely the angle of rotation which is required to align the straight through passage 26 with the inlet passage 16 and the outlet passage 17. In between those two positions, no alignment, occurs and no flow occurs.

Figure 5:
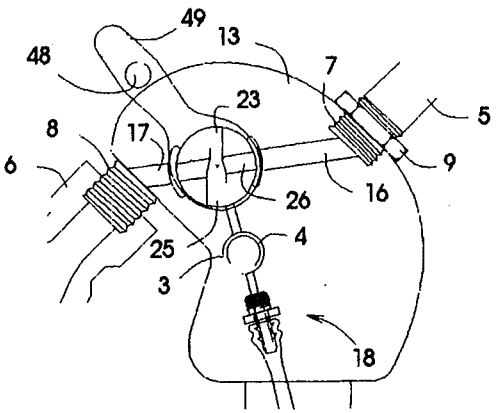
FIG. 5(*a*) is a side view of a soap dispenser in accordance with the present invention showing the main valve operated to the "soap" application position.
Figure 5:
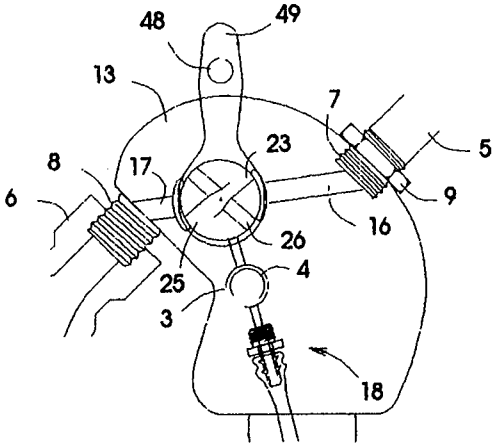
Figure 5:
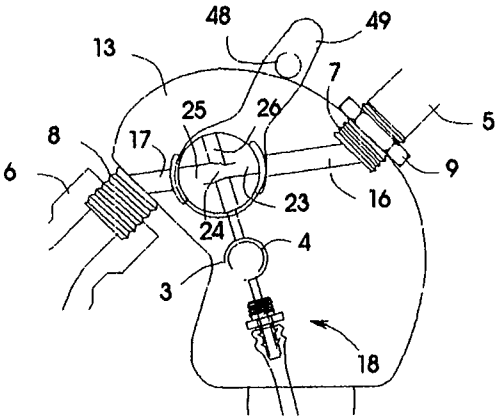

The positions of the main valve element 15 which produce these functions are illustrated in FIG. 5. In FIG. 5(*a*) the main valve element 15 is shown in its soap position. In this position, the restricted passage 24 aligns with the water inlet 16. The straight passage 26 aligns with the mixture passage 19. Water enters the restricted passage 23 and transits the passage emerging at the outlet 24 of the restricted passage. The low pressure produced by the venturi effect at this flare 24 is communicated to the mixture passage 19 by way of one-half of the straight passage 26 of the main valve element 15. Because of the design of the main valve 2, the other one-half of the straight passage 26 becomes a secondary mixing chamber and is effectively scaled from communication with either the water passage or the outside ambient air. Soap under the urging of atmospheric pressure in the reservoir therefore causes the soap/air mixture to rise through the upper part at passage 19, eventually intercepting the water stream where it becomes commingled into the water. The reservoir must be in communication with the outside ambient air by way of a vent or by loose fitting threads connection to the body 13 of the dispenser, in order to establish ambient atmospheric pressure in the reservoir 10 and allow easy flow of the liquid soap.

In FIG. 5(*c*) the main valve element 15 is shown in its rinse position. In this position, the straight through passage 26 aligns with the water inlet 16. Again the design of the main valve 2 prevents the restricted passage 23 from aligning with any passages. Water enters the straight passage 26 from the water conduit 16, and passes unimpeded through the passage emerging at the outlet conduit 17 from where it is directed into the shower head 6.

In FIG. 5(*b*) the main valve element 15 is shown in its off position. In this position, none of the passages of the main valve element 15 align with passages in the body 13. Accordingly neither soap, air nor water flows through the device.

Although particular embodiments have been described, it will be appreciated by those skilled in the art that the present invention is not limited merely to those embodiments shown. Many variations and modifications can be made without departure from the spirit of the present invention. For example, the materials, the particular shapes, and the arrangement of the body and the shape and arrangements of the valves, as well as their particular locations, can be changed from those which are specifically illustrated. These and other variations are specifically contemplated. Accordingly, variation of the preferred form and the particulars as described for the present invention may be undertaken without departure from the scope of the invention which is defined only by the claims which follow.

What is claimed is:

1. A soap dispenser for mixing a liquid soap from a soap reservoir, and air, into a flowing water stream from a pressurized water source, and for delivering water having entrained soap and air to an outlet, for ultimate delivery to the user, comprising:

a body, having an inlet (7), an outlet (8), and a main valve cavity (14) having an essentially circular cross section, and having:

an inlet passage (16) communicating between the inlet (7) and the main valve cavity (14), an outlet passage (17) communicating between the main valve cavity (14), and the outlet (8)

a soap supply valve cavity (20) having a soap supply valve seat (22), an air supply valve cavity (28), a soap supply passage (19) having a first section communicating between the main valve cavity (14) and the soap supply valve cavity (20) and having a second section communicating between the soap supply valve cavity (20) and the soap reservoir (10), and an air supply passage (34) communicating between the air supply valve cavity (28) and the soap supply passage (19);

a main valve element (15) having an essentially cylindrical form, and rotatably mounted within the main valve cavity (14), said main valve element having:

a metering passage (23, 24, 25), having an inlet section (23) and an outlet section (25), wherein the metering passage inlet section (23) has a cross-sectional area smaller than the cross-sectional area of the inlet passage (16), and wherein the metering passage outlet section (25) has a cross-sectional area larger than the cross-sectional area of the metering passage inlet section (23), said metering passage inlet section (23) and metering passage outlet section (25) extending approximately diametrically through the valve element and being positioned so that when the valve element is rotated to a first position the metering passage inlet section (23) communicates with the body inlet passage (16) and the metering passage outlet section (25) communicates with the body outlet passage (17), and a straight-through passage (26) having an inlet and an outlet, said straight-through passage (26) extending through the main valve element (15) at approximately its diameter, and communicating with the intersection (24) of the metering passage inlet section (23) and the metering passage outlet section (25), said soap supply passage (19) being positioned so that when the valve element is rotated to the first position the straight-through passage (26) communicates with the soap supply passage (19), and when the main valve element (15) is rotated to a second position the straight-through passage (26) communicates with the body inlet passage (16) and the body outlet passage (17);

a soap supply valve element (21) adapted to match to the soap supply valve cavity (20) and adjustably closeable with respect to the soap supply valve seat (22), whereby a restriction provided by the soap supply valve element (21) in conjunction with the soap supply valve seat (22) may be adjustably set;

an air supply valve element (29) adapted to match and adjustably closeable with respect to the air supply valve cavity (28), whereby a restriction provided by the air supply valve element (29) in conjunction with the air supply valve cavity (28) may be adjustably set.

* * * * *